United States Patent [19]

Moses

[11] 4,055,195

[45] Oct. 25, 1977

[54] FLUID-RESERVOIR HAIR COMB

[76] Inventor: Lawrence L. Moses, 1917 Vineyard Ave., Los Angeles, Calif. 90016

[21] Appl. No.: 684,367

[22] Filed: May 7, 1976

[51] Int. Cl.[2] ..... A45D 24/22

[52] U.S. Cl. ..... 132/115

[58] Field of Search ..... 132/112–115, 132/11 R; 401/28, 190

[56] References Cited

U.S. PATENT DOCUMENTS

| | | | |
|---|---|---|---|
| 665,608 | 1/1901 | Kotz | 132/113 |
| 1,629,389 | 5/1927 | Johnson | 132/114 |
| 2,259,931 | 10/1941 | Griffith | 132/113 |
| 2,295,746 | 9/1942 | Metzler | 132/114 |
| 2,381,048 | 8/1945 | Habostad | 132/113 |
| 2,897,826 | 8/1959 | DiVito | 132/114 |

*Primary Examiner*—G.E. McNeill

*Attorney, Agent, or Firm*—I. Morley Drucker

[57] ABSTRACT

This invention is directed towards a hair comb which includes a fluid (e.g., hair oil) reservoir in the body of the comb. The fluid in the fluid reservoir is positively ejected under the influence of an air pump into the teeth of a comb. The fluid passes through an adjustable needle valve so that the feed rate to the teeth of the comb is precisely variable over a wide range. The fluid then passes around roller or ball bearings mounted in the teeth ends of the comb, for uniform distribution over the hair and scalp. The combination of a positive pressure fluid dispenser, and adjustable needle valve to control the positive flow of oil and distribution means, via roller bearings, provides an improved, precisely controllable, oil-reservoir hair comb with uniform fluid distribution.

3 Claims, 4 Drawing Figures

FLUID-RESERVOIR HAIR COMB

BACKGROUND OF THE INVENTION

Oil reservoir hair combs are known in the prior art. The closest patents known to the applicant are listed below:

| PATENT NO. | PATENTEE | ISSUE DATE |
|---|---|---|
| 1,065,814 | A. E. Lambert | 6-24-13 |
| 2,539,634 | L. H. Pepin | 1-30-51 |
| 2,624,348 | C. I. Matson | 1-6-53 |
| 2,295,746 | N. R. Metzler | 9-15-42 |
| 2,897,826 | S. S. Di Vito | 8-4-59 |
| 1,449,096 | F. M. Grieten | 3-20-23 |
| 1,436,776 | P. Nach | 11-28-22 |
| 3,101,086 | S. S. Di Vito | 8-20-63 |

These references do not show a means for precisely dispensing, under positive pressure, a fluid, e.g., oil, to the teeth of the comb, and its subsequent uniform distribution from the comb teeth onto the hair. This invention provides an economical means for achieving such a desirable result.

DETAILED DESCRIPTION OF THE INVENTION

Figure 1:
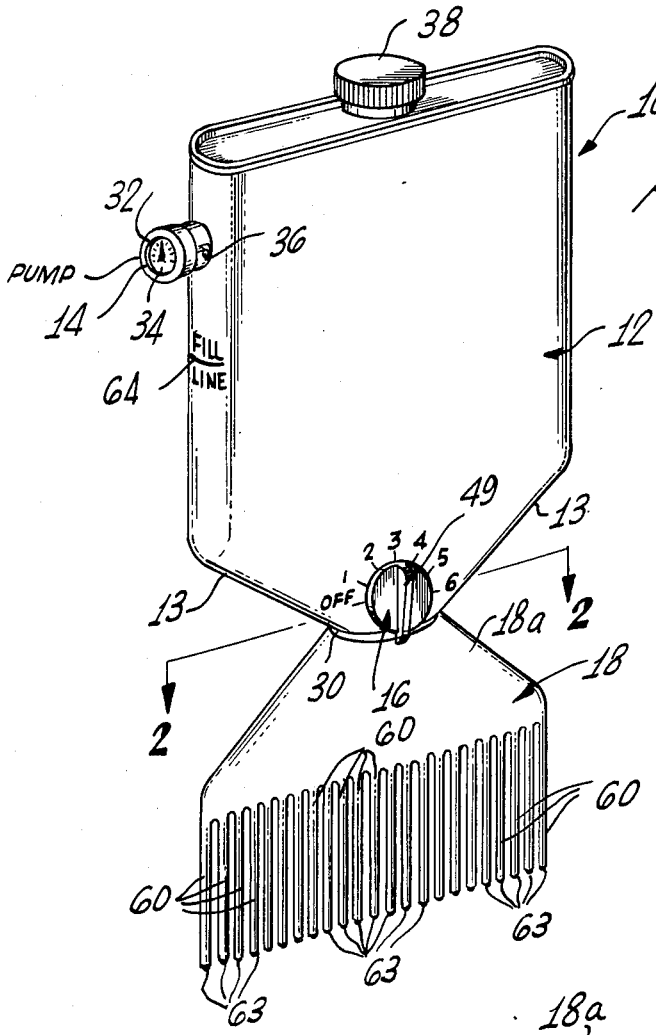
FIG. 1 is a perspective view of the fluid reservoir hair comb, of this invention.

The fluid reservoir hair comb of this invention is generally designated by the numeral 10. The hair comb 10 comprises a fluid reservoir body 12, an air pump 14, mounted to the reservoir body 12, an adjustable needle valve means 16, provided at the lower end of the reservoir body, and comb body 18 carrying the teeth portion of the hair comb. The just enumerated main parts of the hair comb are made preferably of metal or inert plastic material.

The reservoir body 12 is generally rectangular in both vertical and horizontal cross-section. The reservoir body 12 has lower inwardly sloping ends 13 forming a lower neck portion 30 of the reservoir body. Mounted within the neck portion 30 is the adjustable needle valve 16, the details of which will be later described.

The fluid reservoir body 12 is provided, in its upper portion, with a conventional piston-type air pump 14, actuated by means of the depression of a button 32. The button 32 preferably contains a gauge 34, for measuring the air pressure within the reservoir body 12, and can be readily depressed by means of a thumb of a user of the hair comb 10. Air entry into the pump 14, is provided by means of port 36. Fluid entry, to the reservoir body 12, is provided by means of a conventional screw-on knurled filler cap 38.

Figure 3:
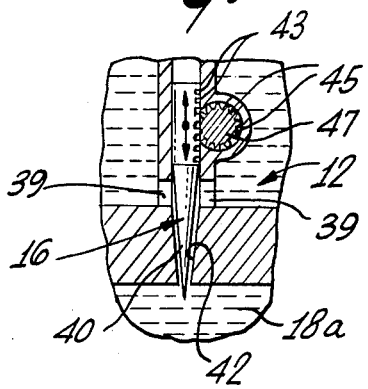
FIG. 3 is a fragmentary, cross-sectional view taken along the line 3—3 of FIG. 2.

The needle valve means 16, provided at the neck 30 of the reservoir body 12, comprises a needle 40, mounted for vertical movement, within needle conduit 42. The needle 42 has a series of notches 43 formed in its upper section, adapted to engage, and mesh with, the teeth 45 of rotatably mounted wheel 47. The vertical movement of the needle is controlled by rotation of the toothed rotatable wheel 47, the wheel 47, in turn, being rotated by means of external knob 48 affixed to the wheel 47, by means of shaft 53. The knob 48 has a raised central portion 49, functioning as the pointer of an indexing means. When the pointer 49 is located at the index numeral zero, the needle 40 is fully seated within needle conduit 42. When indexing means 42 is set at the index numeral 6, this corresponds to the maximum open position of the needle valve means 16, i.e., needle 40 is in the uppermost vertical position with respect to conduit 42. When the needle 40 is unseated from the conduit 42, as shown in FIG. 3, fluid from reservoir 12 will flow, through ports 39, into comb body 18 via conduit 42.

Figure 4:
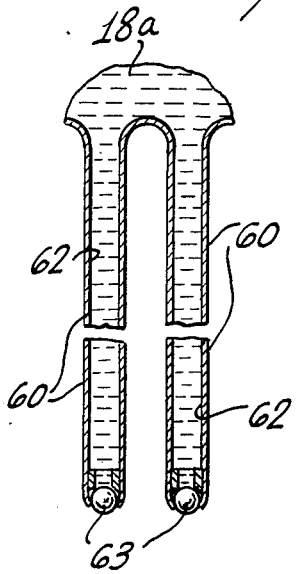
FIG. 4 is a fragmentary, cross-sectional view of the comb teeth, taken along the line 4—4.
Figure 2:
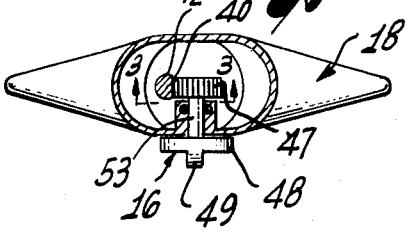
FIG. 2 is a cross-sectional view taken along the line 2—2 of FIG. 1, showing the needle valve structure in particular.

The comb body 18 is provided with a plurality of teeth 60, each of which has an inner bore 62, fluid connected to the upper portion of the comb body 18*a*, as best seen in FIG. 4. A roller ball or roller bearing 63, is rotatably mounted within the end of each tooth 60 to permit release of oil in bore 62 upon movement of the comb through a person'hair, in a uniform manner.

In operation, the filler cap 38 is removed, and a fluid, such as hair oil, is added to the reservoir body 12, preferably up to the fill line mark 64. It is preferred that the needle valve 40-42 be set at zero during the fill operation, and that the needle valve remain at zero until the hair is to dispense fluid.

At the time of use, positive pressure is created within the reservoir body 12, by actuating the air pump 14, and compressing the air above the fluid level, to a predetermined positive pressure, above atmospheric pressure, as measured by gauge 34. The needle valve setting is then adjusted to a point above zero, e.g., to setting No. 3, as shown in FIG. 1, when dispensing of fluid from the rollers 63 of teeth 60 is desired.

The aforedescribed combination of a positive pressure fluid dispense, adjustable needle valve to control the positive flow of oil and distribution means, via roller bearings, provides an improved, precisely controllable, oil-reservoir hair comb with uniform fluid distribution to the hair and scalp.

I claim:

1. A fluid-reservoir hair comb comprising:

a fluid reservoir;

means for providing positive pressure within said fluid reservoir;

a comb body;

a plurality of teeth, each having a bore, fluid-connected to said comb body;

a plurality of roller bearings, each of said roller bearings being mounted, for rotational movement only, within an outer end of each of said bores of said teeth; and an adjustable valve means which in its open position, fluid-connects said fluid reservoir body to said comb body to provide uniform flow of fluid, from said fluid reservoir, through said valve means, into said comb body and through each of said bores of said teeth to wet said roller bearing and dispense said fluid uniformly to a person's hair, and scalp by means of the rotational movement of said roller bearings.

2. The hair comb of claim 1 wherein said means for providing positive pressure within said fluid reservoir is an air pump.

3. The hair comb of claim 1 wherein said adjustable valve means comprises a needle valve, a conforming valve seat, and means for moving said needle valve to any of a series of positions with respect to said valve seat.

* * * * *